US006305474B1

(12) United States Patent
Roberts et al.

(10) Patent No.: US 6,305,474 B1
(45) **Date of Patent: *Oct. 23, 2001**

(54) SCOOP FOR USE WITH AN ANCHOR SYSTEM FOR SUPPORTING A WHIPSTOCK

(75) Inventors: William M. Roberts, Tyler; J. Brandon Guillory, Houston, both of TX (US)

(73) Assignee: Smith International, Inc., Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/302,982

(22) Filed: Apr. 30, 1999

(51) Int. Cl.[7] ..... E21B 7/08
(52) U.S. Cl. ..... 166/313; 166/117.6
(58) Field of Search ..... 166/380, 387, 166/117.6, 313; 175/73, 76

(56) References Cited

U.S. PATENT DOCUMENTS

| | | | | |
|---|---|---|---|---|
| 5,129,453 | | 7/1992 | Greenlee | 166/119 |
| 5,871,046 | * | 2/1999 | Robison | 166/117.6 |
| 6,019,173 | * | 2/2000 | Saurer et al. | 166/117.6 |

FOREIGN PATENT DOCUMENTS

| | | | |
|---|---|---|---|
| 2271791 | 2/1994 | (GB) | E21B/4/18 |
| 2293187 | 3/1996 | (GB) | E21B/7/06 |
| WO94/29563 | 12/1994 | (WO) | E21B/7/08 |

* cited by examiner

*Primary Examiner*—William Neuder

(57) ABSTRACT

A scoop capable of orienting a orientable downhole tool, such as a whipstock assembly, comprising: an orienting member that includes a helical upper surface that terminates in a first pin engaging slot. The pin engaging slot includes upper and lower closed ends such that when the orientable downhole tool advances toward the orienting member, a pin on the orientable downhole tool engages the helical upper surface and orients the orientable downhole tool assembly and when said pin on the orientable downhole tool assembly engages the slot, the orienting member resists axial movement in either axial direction and resists rotational movement in either rotational direction. An alternative embodiment comprises: an orienting key member that includes a helical upper surface that terminates in a first pin engaging slot, and a supplemental member including at least one guide surface terminating in a second pin engaging slot, wherein the orienting member and the supplemental member are concentrically engaged and axially positioned relative to each other such that when the orientable tool advances axially toward the scoop, an orienting pin on the orientable tool engages the helical upper surface and azimuthally orients the orientable tool before a supplemental pin on the orientable tool engages said supplemental member.

28 Claims, 4 Drawing Sheets

SCOOP FOR USE WITH AN ANCHOR SYSTEM FOR SUPPORTING A WHIPSTOCK

RELATED APPLICATIONS

Not Applicable.

TECHNICAL FIELD OF THE INVENTION

The present invention relates generally to an apparatus for supporting and resisting rotation of a whipstock in a desired position in a well. More particularly, the present invention relates to a slip device that prevents rotation of the tool, and to a whipstock key that has a single locking orientation but provides axial supports at multiple azimuthal positions.

BACKGROUND OF THE INVENTION

Once a petroleum well has been drilled and cased, it is often necessary or desired to drill one or more additional wells that branch off, or deviate, from the first well. Such multilateral wells are typically directed toward different parts of the surrounding formation, with the intent of increasing the output of the well. Because the location of the target formation typically falls within a known azimuthal range, it is desirable to control the initial orientation of the deviation fairly precisely.

In order to drill a new borehole that extends outside an existing cased wellbore, the usual practice is to use a work string to run and set an anchored whipstock. The upper end of the whipstock comprises an inclined face. The inclined face guides a window milling bit laterally with respect to the casing axis as the bit is lowered, so that it cuts a window in the casing. The lower end of the whipstock is adapted to engage the anchor in a locking manner that prevents both axial and rotational movement.

It has been found that conventional whipstock supports may be susceptible to small but not insignificant amounts of rotational movement. Hence, it is desired to provide an anchor and whipstock setting apparatus that effectively prevent the whipstock from rotating. It is further desired to provide a system that can set the packer and anchor the whipstock in a single trip. It is further desired to provide an effective whipstock support that can be run in and set using conventional wireline methods.

Furthermore, in prior art devices, disengagement of the whipstock from the orienting key is typically prevented by a shear pin or similar device. The load capacity of this device limits the amount of load that can be placed on the tool. Hence, it is further desired to provide a key element that resists unintentional disengagement while allowing a greater downhole load to be supported by the tool.

In addition, relative rotation of the components of prior art devices is typically resisted by a key or straight spline. The separation of duties (orienting, resisting rotational movement, and resisting axial movement) in the prior art, and the performance of these duties by separate mechanisms resulted in a tool that was relatively complex and susceptible to a variety of failure modes. Hence, it is desirable to provide a tool that combines performance of these duties in, single, robust device.

SUMMARY OF THE INVENTION

The present invention provides an anchor and whipstock setting apparatus that effectively prevents the whipstock from rotating. According to a preferred embodiment, the present tool includes a frangible slip ring that includes a tongue-and-groove interface with the bottom sub of the tool, so as to resist rotation about the tool axis when the slips engage the casing. The tongue and groove interface provides a plurality of interface surfaces that can bear rotational loads and thus resist rotation better than previously known devices.

The present invention further provides a key, or scoop, that resists unintentional disengagement of the stinger from the key element. The preferred scoop includes a two part locking device that includes at least one, and preferably at least three, pin engaging slots. The preferred scoop comprises inner and outer concentric tubular members, each including at least one pin engaging slot. In this manner, the key element provides a single orientation, while simultaneously providing axial support at multiple points around the azimuth of the tool and allowing greater loads to be supported.

A further object of the present invention is to provide an apparatus that allows anchoring and orienting a whipstock in a well casing on a single trip of a running string into and out of the casing or using two trips with wireline tools.

BRIEF DESCRIPTION OF THE DRAWINGS

For a detailed description of the preferred embodiments of the present invention, reference will now be made to the Figures, wherein.

During the course of the following description, the terms "above" and "below" are used to denote the relative position of certain components with respect to the distance to the surface of the well, measured along the wellbore path. Thus, where an item is described as above another, it is intended to mean that the first item is closer to the surface and the second, lower item is closer to the borehole bottom.

DETAILED DESCRIPTION OF THE PREFERRED EMBODIMENTS

Figure 1A:
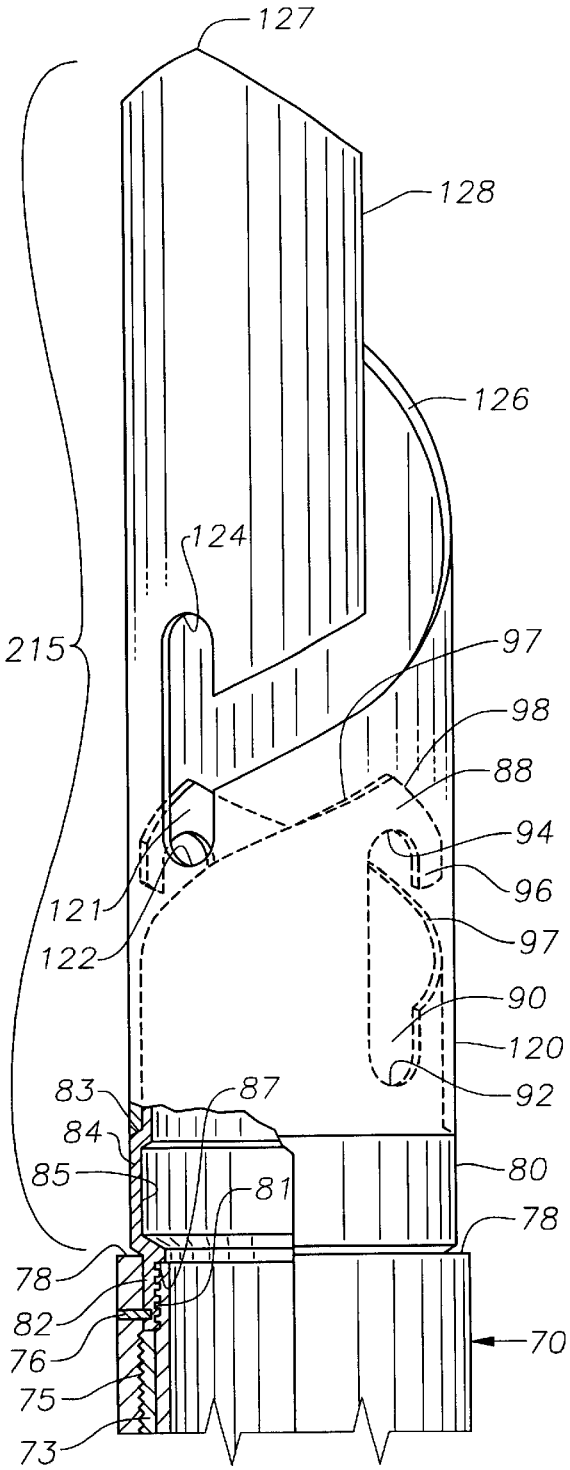
FIGS. 1A and 1B are partial cutaway side views of a preferred embodiment of the present invention.
Figure 1B:
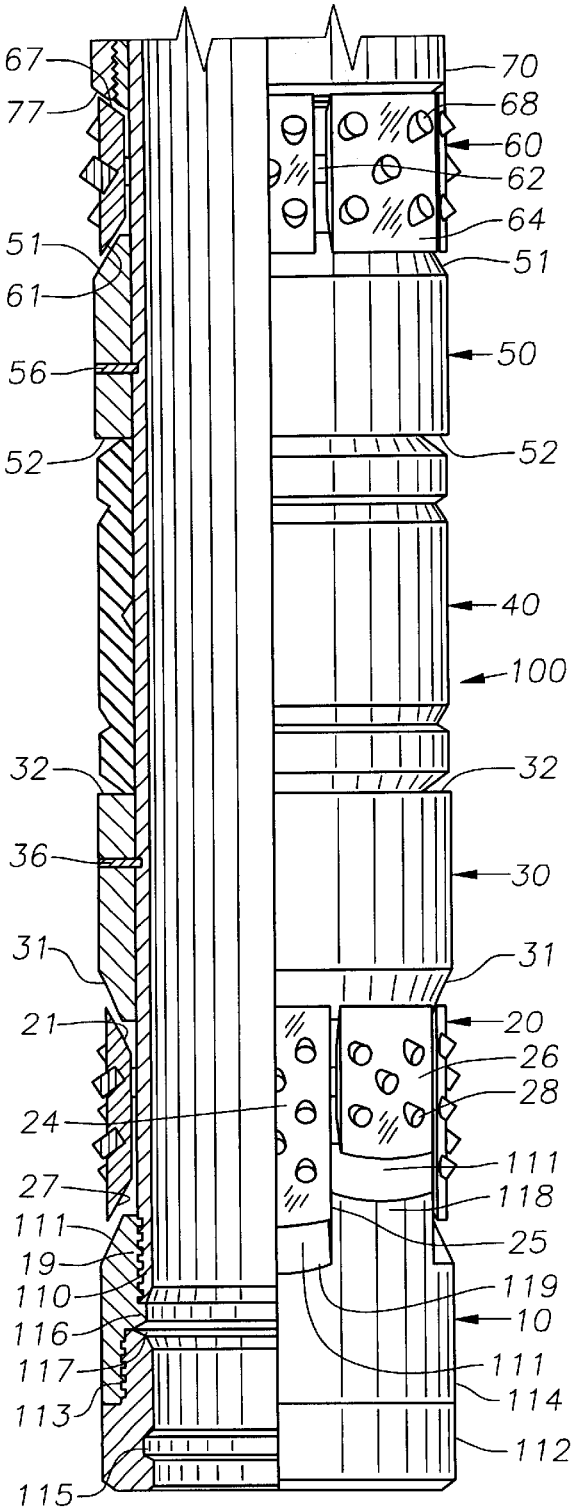

Referring initially to FIGS. 1A and 1B and beginning at the lower end of the tool, the present whipstock setting tool 100 preferably includes a bottom sub 10, lower slip member 20, lower cone 30, packer assembly 40, upper cone 50, upper slip member 60, lock ring retainer 70, and a scoop 215. Scoop 215 preferably comprises an inner hook portion 80 and an outer hook portion 120. In addition, a mandrel 110, is rigidly affixed to and extends between bottom sub 10 and inner hook portion 80.

Bottom sub 10 preferably comprises first and second members 112, 114, respectively, which are threaded together at 113. First bottom sub member 112 defines a lower annular channel 115. Second bottom sub member 114 includes a shoulder 116 at its lower end such that an upper annular channel 117 is defined between first and second members 112, 114. At its upper end, second bottom sub member 114 includes tongue and groove sections 118, 119 respectively. Each section 118, 119 preferably includes a camming surface 111 at its upper end. Surfaces 111 are preferably planar. Second bottom sub member 114 is rigidly affixed to mandrel 110 at threads 19.

Figure 2:
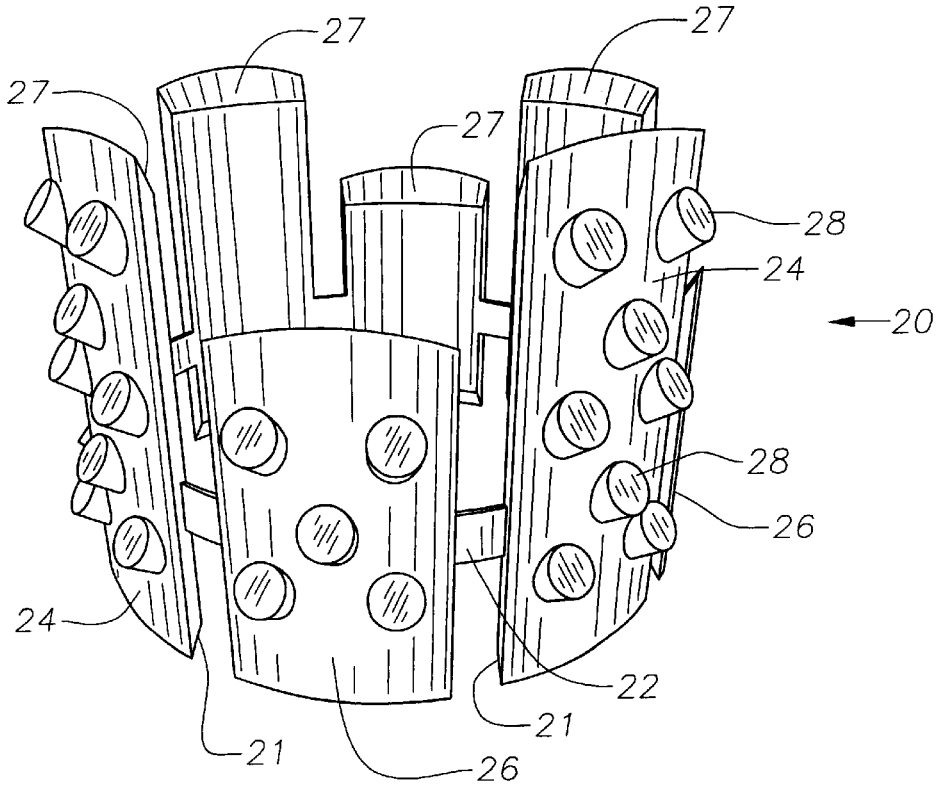
FIG. 2 is a perspective view of the lower slip member of the present invention.

Referring now to FIGS. 1A, 1B and 2, lower slip member 20 initially comprises a continuous ring 22 having alternating tongue and groove sections 24, 26, respectively, positioned around its circumference. Each section 24, 26 preferably includes a frustoconical camming surface 21 at its upper end and a planar camming surface 27 at its lower end. Each planar camming surface 27 is adapted to engage a corresponding camming surface 111 on a bottom sub groove or tongue section 119, 118 respectively. In this manner, a region of axial overlap between lower slip member 20 and bottom sub 10 is provided. In this region, an interface 25 is provided between each tongue 24 of the slip member and the adjacent tongues 118 of the bottom sub. Interfaces 25 provide bearing surfaces that allow the transmission of torque between lower slip member 20 and bottom sub 10, as described in detail below.

In an alternative embodiment, slip pads 24, 26 have equal axial lengths, but are still provided with planar camming surface 27. Correspondingly, sections 118, 119 of bottom sub 10 have equal axial lengths and are still provided with planar camming surface 111. Particularly in large diameter permanent packers, this configuration provides sufficient torque resistance for many operations.

Still referring to FIGS. 1A, 1B and ring 22 may be scored between adjacent pads 24, 26, to facilitate fracture of the ring 22 as described below. The alternating tongue and groove pads 24, 26 each preferably include a plurality of tungsten carbide inserts 28. As best seen in FIG. 1B, inserts 28 preferably comprise generally cylindrical slugs that are mounted with their longitudinal axes inclined with respect to the tool axis and their faces oriented downward and radially outward. In an alternative preferred embodiment, one or more of the carbide inserts are rotated so that their faces are oriented more or less in a circumferential direction. Most preferably, at least two of the slip pads 24, 26 having at least some of their inserts oriented with a circumferential component and inserts on separate pads have opposite circumferential directions, i.e. counter-clockwise versus clockwise. In an alternative embodiment, grooves cut in the outer surface of the slips pads 24, 26 in either a circumferential or longitudinal direction, or both, can be used in place of or in combination with the carbide inserts.

Referring again to FIGS. 1A and 1B, cones 30 and 50 can be any suitable configuration, such as are generally known in the art. In one embodiment, lower cone 30 includes a frustoconical camming surface 31 at its lower end and a compression surface 32 at its upper end. Correspondingly, upper cone 50 includes a frustoconical camming surface 51 at its upper end and a compression surface 52 at its lower end. In the tool's initial configuration, each cone 30, 50 is preferably held in position relative to mandrel 110 by means of one or more shear pins or screws 36, 56, respectively.

Packer assembly 40 is disposed between compression surfaces 32 and 52. Packer assembly 40 can be any suitable configuration and composition, including an elastomeric body that is preferably, but not necessarily, supported by a knitted wire mesh, or a "petal basket" configuration, such as are known in the art. In an alternative embodiment, packer assembly 40 is replaced with an alternative biasing means, such as a coil spring, Belleville springs, or the like, or is eliminated altogether.

Above upper cone 50, upper slip member 60 is held in place by lock ring retainer 70. Like lower slip member 20, upper slip member 60 preferably includes a ring 62 that supports a plurality of slip pads 64. Each slip pad 64 includes a lower frustoconical camming surface 61 at its lower end and an upper frustoconical camming surfaces 67 at its upper end. Each slip pad 64 preferably also includes a plurality of tungsten carbide inserts 68 affixed to its outer surface, with the end face of each insert 68 oriented upward and radially outward.

Lock ring retainer 70 includes a camming surface 77 at its lower end, a threaded surface 75 on its inner surface, and an annular bearing surface 78 at its upper end. A lock ring or ratchet ring 73 has an outer surface that engages threaded surface 75 and an inner ratchet surface that engages a corresponding ratchet surface on the outer surface of mandrel 110. Both ratchet surfaces preferably comprise a plurality of teeth or grooves capable of resisting relative axial movement, such as are known in the art. In the tool's initial configuration, lock ring retainer 70 is preferably prevented from rotating by one or more shear pins or screws 76, which engage inner hook portion 80. Inner hook portion 80, in turn, is threaded onto the upper end of mandrel 110 at threads 81 as described below.

Figure 3:
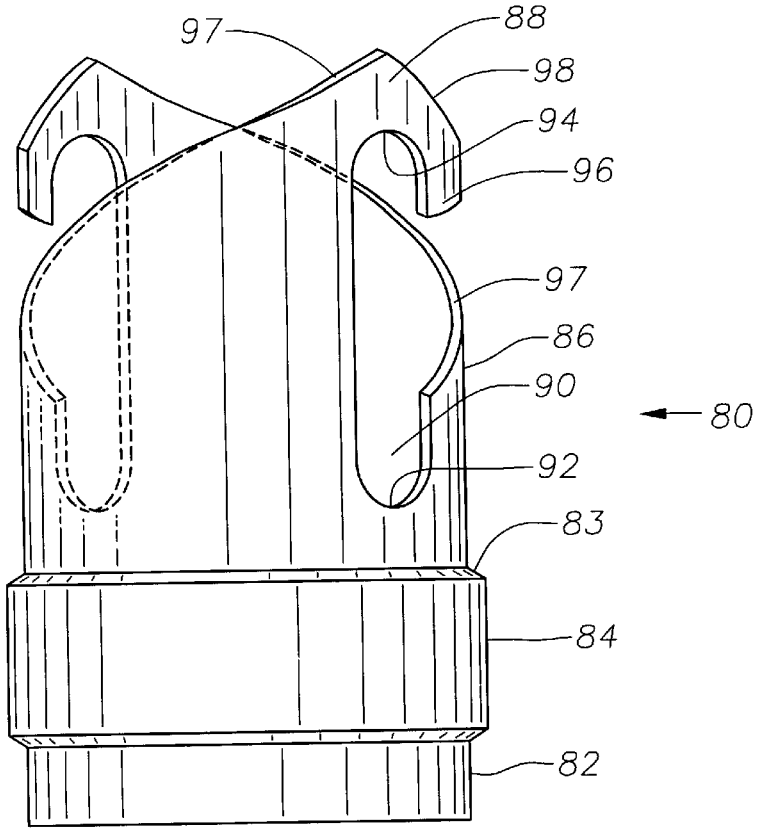
FIG. 3 is a side view of the inner locking device of the present invention.

Referring now to FIGS. 1A, 1B and 3, inner hook portion 80 comprises a generally cylindrical tube, having an engagement portion 82, an enlarged diameter portion 84, and a latch portion 86. Engagement portion 82 preferably includes female threads 81 for engaging mating threads on the upper end of mandrel 110. Shear pin(s) 76 preferably also engage portion 82. Enlarged diameter portion 84 defines an outer annular shoulder 83, an inner annular channel 85, and an inner annular lip 87, which preferably engages the upper end of mandrel 110.

Still referring to FIG. 3, the latch portion 86 of inner hook portion 80 preferably comprises a pair of hooks 88, each of which generally resembles an inverted "J." Specifically, each hook 88 includes an elongate slot 90, which is generally parallel to the tool axis and has lower and upper slot ends 92, 94, respectively. Upper slot end 94 is defined by a finger 96, which includes a left inclined edges 97 and a right inclined edge 98. The left inclined edge 97 of each hook extends downward until it intersects the lower slot end 92 of the adjacent hook. It will be understood that, while hooks 88 are 180 degrees apart in a preferred embodiment, the configuration described with respect to hooks 88 can be altered to include any number of hooks evenly or unevenly spaced about the body of inner hook portion 80, limited only by space constraints.

Referring again to FIGS. 1A and 1B, in which inner hook portion 80 is shown partially in phantom, outer hook portion 120 is sized to fit snugly over the outside diameter of inner hook portion 80, and to rest on outer annular shoulder 83. Outer hook portion 120 includes a single elongate slot 121, which is generally parallel to the tool axis and includes lower and upper slot ends 122, 124, respectively. The upper edge of outer hook portion 120 includes a helical inclined edge 126, which spirals upward from the right side (as drawn) of slot 121, through approximately 360 degrees until it reaches an apex 127. From apex 127, the upper edge of outer hook portion 120 spirals downward through approximately 40 degrees before terminating at a substantially longitudinal guide surface 128. In this manner, outer hook portion 120 defines an orienting key structure that is capable of receiving and thereby orienting a suitably adapted stinger in a single orientation.

As can be appreciated from FIGS. 1A and 1B, inner hook portion 80 and outer hook portion 120 are configured such that when assembled, slots 90 in inner hook portion 80 are axially offset from slot 121 in outer hook portion 120. In addition slots 90, which in one preferred embodiment are positioned 180° apart, are oriented approximately perpendicularly to a radius from the tool axis through the center of slot 121. Inner hook portion 80 and outer hook portion 120 are preferably rigidly affixed together in the desired orientation by welding at a plurality of points (not shown) around their circumference. Alternatively, they may be fasted together by any suitable means, or may be made as an integral piece, if desired.

It will be understood from the foregoing that scoop 215 is capable of serving three functions: orienting a tool, providing axial support, and providing rotational support (resisting rotation). All three functions can be served by a single hook alone, such as that of outer hook portion 120. The additional, or supplemental, hooks provided in the preferred embodiment merely distribute the axial and rotational loads and are not vital to operation of the invention.

Figure 4A:
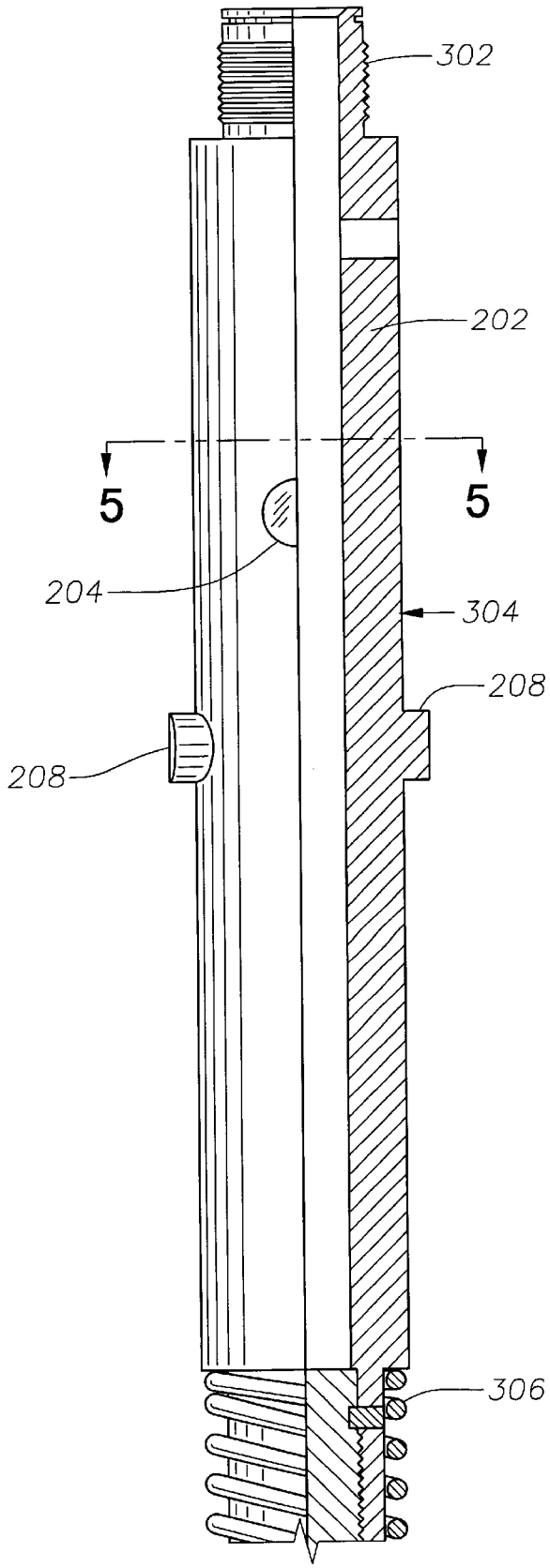
FIGS. 4A and 4B are side views of the latch down mechanism that engages the locking device shown in FIGS. 1A and 1B.
Figure 4B:
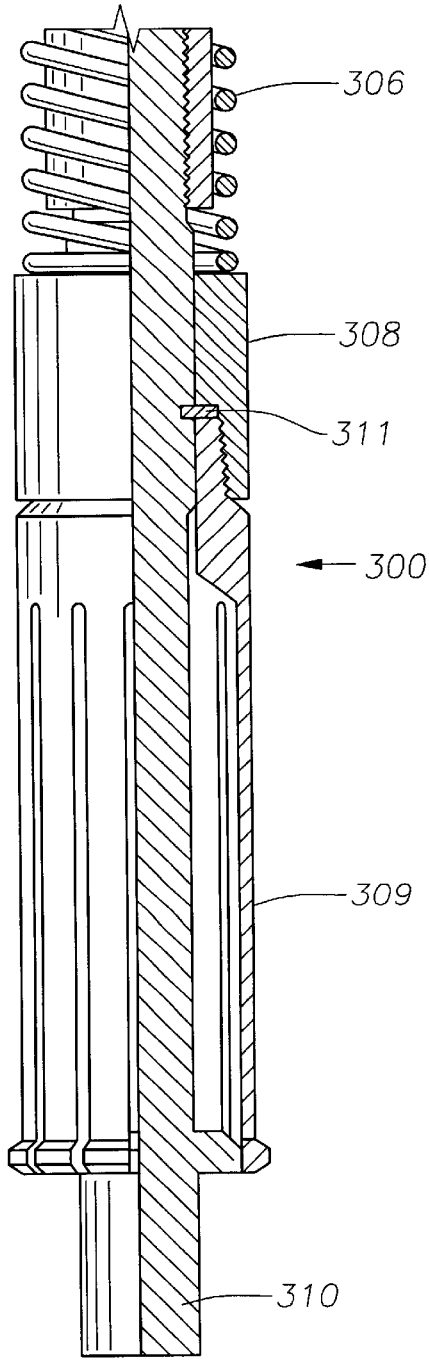
Figure 5:
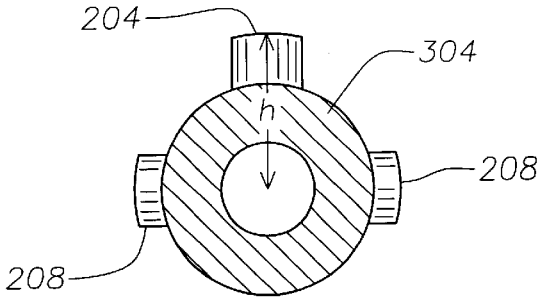
FIG. 5 is a cross-sectional view taken along the lines 5—5 of FIG. 4.

Referring now to FIGS. 4A, 4B and 5, a latch down mechanism 300 such as may be used with the present invention may comprise a threaded connection 302, a stinger 304, a spring 306, a shear ring retainer 308, which retains a shear ring 311, a collet mechanism 309, and a collet support 310. With the exception of stinger 304, the components of latch down mechanism 300 are essentially analogous to those of a conventional latch down mechanism and will not be explained in detail. In one anticipated application the threaded connection 302 is used to attach latch down mechanism 300 to the bottom of a whipstock. Stinger 304 is adapted to engage scoop 215 and includes a tubular body 202 having a plurality of pins 204, 208, 208 extending radially therefrom. The outer diameter of body 202 is preferably sized to fit closely within the inner diameter of inner hook portion 80. Pins 204, 208, 208 are preferably integral with body 202 and are arranged so that their axial and azimuthal positions correspond to the positions of the three slots 121, 90, 90. The radial height h of each pin, as measured from the tool axis to the outer surface of the pin, is set to correspond to the radius of the outer surface of the hook that it will engage. Hence, the height of pin 204 is greater than the height of pins 208, because it engages slot 121 and has a height approximately equal to the radius of the outer surface of outer hook portion 120. Correspondingly, pins 208 have a height corresponding approximately to the radius of the outer surface of inner hook portion 80. Because they engage the supplemental slots 90, pins 208 are sometimes herein referred to as supplemental pins.

The slots 121, 90 of scoop 215 are preferably sufficiently axially spaced apart that pin 204 engages and is oriented by outer hook portion 120 before or simultaneously with the engagement of pins 208 with inner hook portion 80. This is important in the preferred embodiment because the bisymmetry of inner hook portion 80 gives two possible positions, 180° apart, in which the stinger could be oriented. By ensuring that the stinger is oriented solely by outer hook portion 120, which has only one possible engaged orientation, the correct orientation of the stinger 304, and hence of the whipstock, is ensured. It will be understood that the number of hooks and slots in outer portion 120 can vary from one to five or more, and is constrained only by space and cost limitations. Likewise, a single hook on inner portion 80 could be used to orient a stinger, while one or more supplemental hooks in outer portion 120 subsequently engage additional pins on the stinger. Alternatively, as stated above, the supplemental hooks can be eliminated, leaving only the orienting hook portion to provide all of the axial and rotational support. In any event, it is desirable to have only a single, first-engaged orientation slot or key, which ensures that only a single final orientation of the stinger can be obtained. When all of the pins reach the proper rotational and longitudinal orientation, they can carry tensile, compressive, and left and right hand rotational forces. Rotation is resisted only when pins 204, 208 engage the upper or lower ends of their respective slots.

Operation

Operation of the present tool will be described first with respect to a one-trip drill string operation, and then with respect to a multi-trip wireline operation. In the one-trip context when it is desired to orient and set a whipstock, the present tool is placed in engagement with the lower end of a whipstock assembly comprising a setting tool that includes a ram (not shown) and latch down mechanism 300 connected to the bottom of a conventional whipstock (not shown) at connection 302. Specifically, latch down mechanism 300 is advanced into scoop 215 until first pin 204 engages the upper edge 126 of outer portion 120 and then all three pins 204, 208 engage their respective slots. The scoop and associated tool below it are advanced axially until pins 204, 208 engage the upper ends 124, 94 of their respective slots. The present tool is then lowered through the casing to the desired depth and oriented to the desired orientation.

Figure 6:
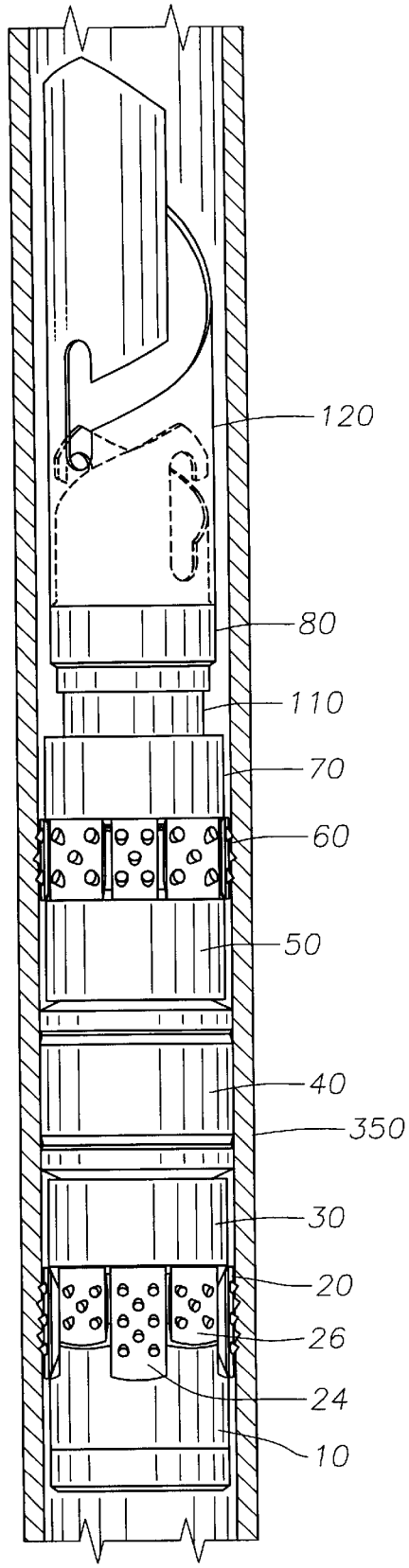
FIG. 6 is a side view of the tool shown in FIGS. 1A and 1B, in place in a casing and with the slips and packer radially expanded.

Referring to FIGS. 1A, 1B and 6, the ram is then actuated while the stinger 304 remains in engagement with scoop 215. The stinger 304 prevents scoop 215, mandrel 110 and bottom sub 10 from shifting axially, while a sleeve (not shown) driven by the ram engages annular bearing surface 78 of lock ring retainer 70 and drives it axially toward bottom sub 10, shearing pins 56 and 36 in the process. This causes engagement of camming surface 77 with camming surface 67, 61 with 51, 31 with 21, and 111 with 27. As lock ring retainer 70 advances toward bottom sub 10, upper and lower slip rings are driven radially outward. This initially causes the rings 62 and 22 to break and separate into a plurality of pads, which then advance radially outwardly until the carbide inserts dig into and engage the inner surface of the casing string 350. At the same time, packer assembly 40 is squeezed between compression faces 32 and 52 and forced radially outwardly against the inside of the casing.

Once the desired compressive force is applied to the tool, the stinger is latched down by advancing a conventional collet mechanism (such as 309) until it engages lower annular channel 115. In the locked-down position, pins 204, 208 engage the lower ends 122, 92 of their respective slots. At this point the whipstock is wholly supported and fixed at the desired depth and azimuthal orientation, and milling can begin. If or when it is desired to remove the whipstock from the whipstock support, the collet mechanism can be released from the bottom sub and the stinger 304 can be disengaged from scoop 215 by left-rotation combined with backing out.

In wireline operations, the foregoing steps are accomplished in a slightly different order. Specifically, the tool 100 is run into the hole to the desired depth and set, using an electrically actuated setting mechanism to apply a downward force on lock ring retainer 70, as described above. Once the desired compressive force has been applied to slips 20, 60 and the tool is set, the azimuthal orientation of scoop 215 is determined by a conventional wireline survey means, by telemetry or any other suitable mechanism. Using the orientation data in combination with the azimuthal location of the target formation, the stinger and whipstock are assembled at the surface so as to achieve the desired azimuthal orientation of the whipstock. The assembled stinger and whipstock are then run into the hole. When the stinger encounters scoop 215, it is guided by surfaces 127 and/or 126 into the correct azimuthal orientation.

Again, a collet mechanism is used to lock the stinger into engagement with scoop 215 during milling. As described above, the collet mechanism can be released from tool 100 by conventional means. In an alternative embodiment, a modified collet mechanism can engage channel 85 in lower hook portion 80 during wireline run-in.

In either case, the pin-and-hook configuration of the present device allows a much greater load to be borne by the present tool than has heretofore been possible. For example, as much as several thousand feet of pipe can be suspended from tool 100. For larger tools this additional load capacity can be as much as 145,000 pounds or more. The load limit is determined by the mechanical strength of pins 204, 208 and inner and outer hook portions 80, 120.

Also in accordance with the present invention, the tongue and groove configuration of the lower slip assembly ensures that no relative rotation will occur between slip member 20 and bottom sub 10. Hence, the precise azimuthal orientation of the whipstock is more likely to be maintained throughout the milling operation, even in the presence of significant torque.

While the present invention has been described in terms of use with a permanent packer, it will be understood that it is suitable for use with a retrievable packer, or with other similar equipment. For example the present scoop can be used in combination with an anchor, a permanent packer, or a retrievable packer.

While the present invention has been described and disclosed in terms of a preferred embodiment, it will be understood that variations in the details thereof can be made without departing from the scope of the invention. For example, the number of pins, the configuration of the scoop surfaces, the number of slip pads and the lengths and relationships of various components, the interaction between the invention and conventional components of the tool, and materials and dimensions of the components can be varied. Likewise, it will be understood that the slip assembly of the present invention and the scoop of the present invention can each be used in combination with other downhole tools. For example, the present slip assembly is suitable for use with a no-turn tool.

What is claimed is:

1. A scoop for use in conjunction with an azimuthally orientable whipstock assembly having at least one pin thereon, comprising:

an orienting member including a helical surface that terminates in a pin engaging slot, said pin engaging slot including upper and lower closed ends such that when the whipstock assembly advances toward the orienting member, the pin on the whipstock assembly engages the helical surface and orients the whipstock assembly and when said pin on the whipstock assembly engages said slot, the orienting member limits axial movement of the pin in either axial direction and resists rotational movement of the pin in either rotational direction.

2. The scoop in accordance with claim 1 wherein the orienting member resists axial movement in a first axial direction when said pin engages said upper slot end and resists axial movement in a second axial direction when said pin engages said lower slot end.

3. A scoop for use in conjunction with an azimuthally orientable whipstock assembly that includes at least an orienting pin and a supplemental pin, comprising:

an orienting member including a helical upper surface that terminates in a first pin engaging slot; and a supplemental member including at least one guide surface terminating in a second pin engaging slot;

said orienting member and said supplemental member being concentrically engaged and axially positioned relative to each other such that when the whipstock assembly advances axially toward the scoop, the orienting pin on the whipstock assembly engages said helical upper surface and azimuthally orients the whipstock assembly at least as early as the supplemental pin on the whipstock assembly engages said supplemental member.

4. The scoop according to claim 3 wherein said supplemental member is received within said orienting member.

5. The scoop according to claim 3 wherein said supplemental member is integral with said orienting member.

6. The scoop according to claim 3 wherein said supplemental member includes two guide surfaces and two slots.

7. The scoop according to claim 3 wherein each pin engaging slot includes a closed upper end capable of receiving and preventing azimuthal rotation of a pin.

8. The scoop according to claim 3 wherein each pin engaging slot includes upper and lower closed ends, each end being capable of receiving and preventing azimuthal rotation of a pin.

9. The scoop according to claim 3 wherein the orienting and supplemental members are configured such that the orienting pin and the supplemental pin simultaneously engage said pin engaging slots.

10. The scoop according to claim 3 wherein the scoop is capable of supporting at least 145,000 lb. of weight.

11. A method for orienting and setting a whipstock assembly, comprising:

(a) providing a scoop having a single orienting slot, the slot having upper and lower closed ends, each end being capable of receiving and preventing azimuthal rotation of a pin;

(b) providing an orienting pin affixed on the whipstock assembly for engaging the slot;

(c) affixing the whipstock assembly to the scoop by advancing the orienting pin into the slot;

(d) suspending the whipstock assembly from the scoop by engaging the upper end of the orienting slot with the orienting pin;

(e) setting the scoop in the hole; and (f) at least partially supporting the whipstock assembly by engaging the lower end of the orienting slot with the orienting pin.

12. The method according to claim 11, further including the steps of providing at least one supplemental slot on the scoop, said supplemental slot having upper and lower closed ends, each end being capable of receiving and preventing azimuthal rotation of a pin, providing a supplemental pin on the whipstock assembly, and engaging the supplemental pin in the supplemental slot when the orienting pin engages the orienting slot.

13. The method according to claim 11, further including the step of disengaging the whipstock assembly from the scoop.

14. The method according to claim 11, further including the step of suspending an additional load from the scoop.

15. A scoop for use in conjunction with an azimuthally orientable downhole tool, comprising:

an orienting member including a helical surface that terminates in a slot such that when the downhole tool advances toward the orienting member, a pin on the downhole tool engages the helical surface and orients the downhole tool and when said pin on the downhole tool engages said slot, the orienting member limits axial movement of the pin in either axial direction and resists rotational movement of the pin in either rotational direction.

16. The scoop in accordance with claim 15 wherein said slot includes upper and lower closed ends such that the orienting member resists axial movement in a first axial direction when said pin engages said upper slot end and resists axial movement in a second axial direction when said pin engages said lower slot end.

17. A scoop for use in conjunction with an azimuthally orientable downhole tool, comprising:

an orienting member including a helical upper surface that terminates in a first pin engaging slot; and a supplemental member including at least one guide surface terminating in a second pin engaging slot;

said orienting member and said supplemental member being concentrically engaged and axially positioned relative to each other such that when the downhole tool advances axially toward the scoop, an orienting pin on the downhole tool engages said helical upper surface and azimuthally orients the downhole tool at least as early as a supplemental pin on the downhole tool engages said supplemental member.

18. The scoop according to claim 17 wherein said supplemental member is received within said orienting member.

19. The scoop according to claim 17 wherein said supplemental member is integral with said orienting member.

20. The scoop according to claim 17 wherein said supplemental member includes two guide surfaces and two slots.

21. The scoop according to claim 17 wherein each pin engaging slot includes a closed upper end capable of receiving and preventing azimuthal rotation of a pin.

22. The scoop according to claim 17 wherein each pin engaging slot includes upper and lower closed ends, each end being capable of receiving and preventing azimuthal rotation of a pin.

23. The scoop according to claim 17 wherein the orienting and supplemental members are configured such that said orienting pin and said supplemental pin on the downhole tool simultaneously engage said pin engaging slots.

24. The scoop according to claim 17 wherein the scoop is capable of supporting at least 145,000 lb. of weight.

25. A method for orienting and setting a downhole tool, comprising:

(a) providing a scoop having a single orienting slot, the slot having upper and lower closed ends, each end being capable of receiving and preventing azimuthal rotation of a pin;

(b) providing an orienting pin affixed on the downhole tool for engaging the slot;

(c) affixing the downhole tool to the scoop by advancing the orienting pin into the slot;

(d) suspending the downhole tool from the scoop by engaging the upper end of the orienting slot with the orienting pin;

(e) setting the scoop in the hole; and (f) at least partially supporting the downhole tool by engaging the lower end of the orienting slot with the orienting pin.

26. The method according to claim 25, further including the steps of providing at least one supplemental slot on the scoop, said supplemental slot having upper and lower closed ends, each end being capable of receiving and preventing azimuthal rotation of a pin, providing a supplemental pin on the downhole tool, and engaging the supplemental pin in the supplemental slot when the orienting pin engages the orienting slot.

27. The method according to claim 25, further including the step of disengaging the downhole tool from the scoop.

28. The method according to claim 25, further including the step of suspending an additional load from the scoop.

* * * * *